United States Patent [19]

Webb

[11] 4,043,473

[45] Aug. 23, 1977

[54] DEVICE TO PREVENT REFILLING OF BOTTLES AND THE LIKE

[76] Inventor: Norma M. Webb, 1532 Alison Drive, West Chester, Pa. 19380

[21] Appl. No.: 755,956

[22] Filed: Jan. 3, 1977

[51] Int. Cl.[2] ..... B65D 49/02

[52] U.S. Cl. ..... 215/21; 215/29

[58] Field of Search ..... 215/17, 18, 20, 21, 215/22, 23, 26, 29, 30; 222/147, 500

[56] References Cited

U.S. PATENT DOCUMENTS

| | | | |
|---|---|---|---|
| 789,757 | 5/1905 | Prouty | 215/29 X |
| 836,852 | 11/1906 | Ambrose | 215/21 |
| 1,063,698 | 6/1913 | Kovac | 215/20 |
| 1,321,411 | 11/1919 | Alo | 215/21 |
| 2,037,514 | 4/1936 | Laube | 215/21 |

FOREIGN PATENT DOCUMENTS

| | | | |
|---|---|---|---|
| 831,754 | 6/1938 | France | 215/21 |

*Primary Examiner*—Donald F. Norton
*Attorney, Agent, or Firm*—Robert B. Frailey

[57] ABSTRACT

A device for insertion into the neck of a bottle, to prevent refilling and reuse of the bottle after its original liquid contents have been depleted. The device includes a valve which opens to permit decanting of the original liquid contents of the bottle, but which closes to prevent refilling of the bottle. Flexible locking means are provided which permit the ready insertion of the device into the neck of the bottle, and prevent its removal following insertion.

14 Claims, 6 Drawing Figures

DEVICE TO PREVENT REFILLING OF BOTTLES AND THE LIKE

BACKGROUND OF THE INVENTION

The present invention relates to devices adapted to be inserted and retained securely within the necks of bottles, such as wine bottles, medicine bottles and the like, to prevent refilling of the bottles after their original liquid contents have been decanted. Devices for preventing the refilling of bottles for reuse are known. There long has been a need for providing a safe, secure, reliable, inexpensive and practical means for preventing the refilling and reuse of bottles after their original liquid contents have been depleted. Many such devices have been patented. But so far as is presently known, none have gove into widespread commercial use. Apparently, such devices heretofore proposed and designed have not been commercially acceptable because they either are of impractical use, or too difficult or too expensive of manufacture. Examples of such prior devices are illustrated in U.S. Pat. Nos. 626,516, 787,188, 1,117,850, 1,190,408, 2,064,002, 2,380,825, 2,382,864, and 2,948,429.

SUMMARY OF THE INVENTION

The primary object of the present invention is to provide a new and improved device, which is practical of use and inexpensive to manufacture, for preventing the refilling of bottles and bottle-like liquid containers for reuse, after their original contents have been depleted.

A further object of the invention is to provide such a device having a novel valve arrangement, including a novel valve control means, whereby a captive valve is moveable to a selected extent to permit discharge of the original liquid from the container, but which retracts to prevent refilling of the container.

A further object is to provide novel valve control means for such a device, which permits automatic opening of a valve during decanting of the original liquid contents of the container, and permits automatic closing of the valve when the container is at rest.

A further object is to provide a new and improved flexible locking means which provides for the ready insertion of the device into the neck of a bottle, but renders impossible removal of the device without breaking the bottle. The novel locking means includes outwardly disposed hook-like or latch-like elements, which are operative to engage in locking arrangement with an internal annular shoulder or shoulder-like ring disposed internally of the neck of the bottle.

A further object is to provide a device for preventing the refilling of bottles and the like which is made of flexible plastic material, which is formed of identical semi-cylindrical, tubular elements that are easy and economical of manufacture and assembly, and which is convenient and practical in use.

Other objects and advantages of this invention will become apparent from the following description of a preferred embodiment of the invention.

DETAILED DESCRIPTION OF THE INVENTION

Figure 1:
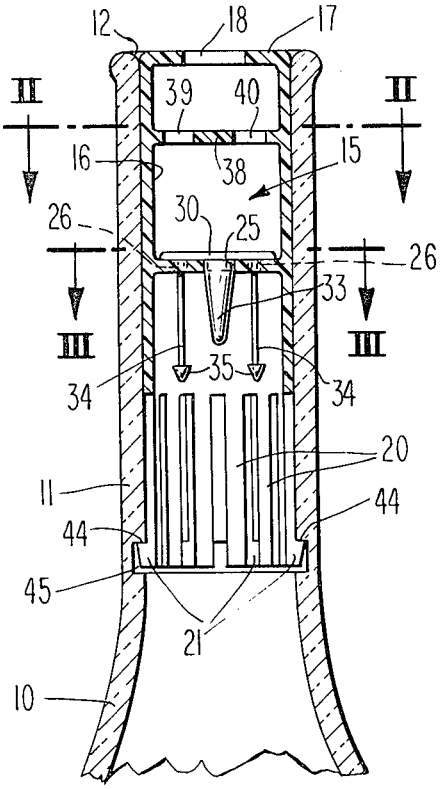
FIG. 1 is a fragmentary view in vertical section of the neck of a bottle vertically at rest, and incorporating a preferred device of this invention to prevent refilling of the bottle, said section being indicated by the arrows I—I of FIG. 2.

In FIGS. 1 to 6 inclusive of the drawing, there is illustrated a bottle 10 having a neck 11 and an opening 12, in which is inserted a device 15 incorporating a preferred embodiment of this invention. The device 15 is of essentially tubular construction, and is adapted to fit snugly within the upper portion of the neck 11 of the bottle 10.

The device 15 incorporates a hollow generally cylindrical body portion 16 having an annular transverse closure element 17 formed adjacent its upper end. The annular closure 17 is provided with a liquid discharge port 18. The lower end of the body portion 16 is provided with a plurality of depending, annularly spaced locking fingers 20. Each of the fingers 20 is an integral extension of the tubular body portion 16, and the fingers are arranged so as to be spaced uniformly about the lower end of the device 15. Disposed at the distal end of each finger 20 is a hook-like or latch-like element 21, said elements 21 extending outward radially relative to the device 15.

Disposed internally of the tubular body portion 16, intermediate of the discharge port 18 and the locking fingers 20, is a transverse valve seat 24. In the preferred embodiment shown, the valve seat 24 comprises a flat disc provided with a centrally located liquid discharge opening 25, and has four small apertures 26 (FIGS. 3,4) disposed radially outward of the opening 25, and spaced at 90° intervals relative thereto.

Figure 5:
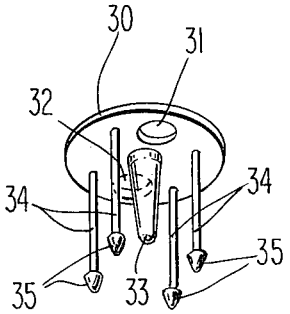
FIG. 5 is an enlarged view in perspective of the moveable valve comprising part of the device.
Figure 3:
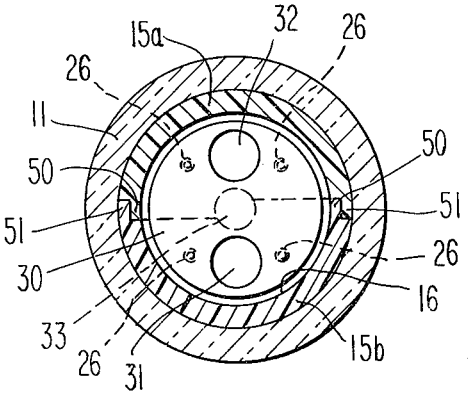
FIG. 3 is an enlarged view in section indicated by the arrows III—III of FIG. 1.

Disposed above the valve seat 24 is a valve 30 which, when the bottle 10 and the device 15 are vertical, as shown in FIG. 1, rests upon the upper surface of the valve seat 24. As best illustrated in FIGS. 3 and 5, valve 30 is provided with a spaced pair of liquid discharge openings 31, 32. Depending from the lower surface of the valve 30 is a centrally disposed, downwardly tapered nipple 33 adapted to engage within and close the central opening 25 in the valve seat 24. The degree of taper of the nipple 33 is such as to permit the upper portion of the nipple to engage within the opening 25 of the valve seat in relatively fluid-tight relation.

Also depending from the lower surface of the valve 30 are four spaced elongated stems 34, each having a protuberance 35 formed at its distal end. The four stems 34 extending from the valve 30 are disposed at 90° intervals, relative to the valve nipple 33, and are aligned co-axially with one of the four valve seat apertures 26. As illustrated in FIG. 1, when the valve 30 is seated at rest on the valve seat 24, the nipple 33 engages with, and extends through, the opening 25 in the valve seat, to close that opening. Each of the four elongated stems 34 extend through the four valve seat apertures 26 and terminate below the valve seat 24. The four stems 34 are slidable axially within, and relative to, the four valve seat apertures 26.

Figure 6:
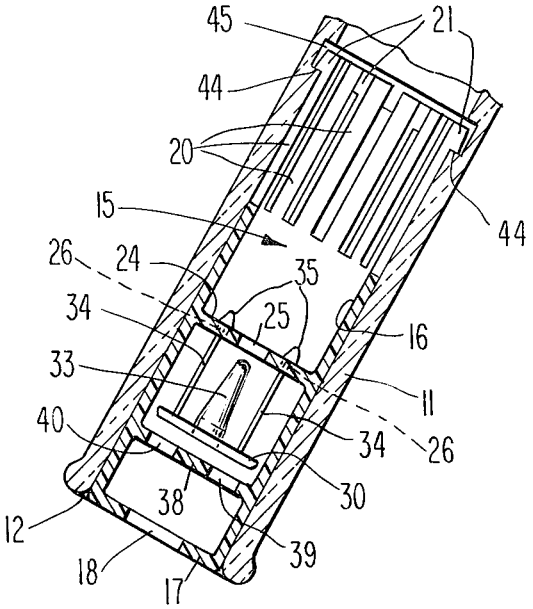
FIG. 6 is a fragmentary view in section showing the neck of the bottle inclined downwardly, in liquid discharging position.

The terminal protuberances 35 disposed on the stems 34 are of generally conical configuration, with their tapered points disposed at the extreme ends of the stems. The design of the mushroom-like protuberances is such that their enlarged, uppermost ends are of a larger diameter than the apertures 26. Because of such conical-like configuration, the insertion or penetration of the protuberances 35 into and through the valve seat apertures 26 is relatively easy, but their withdrawal therefrom is rendered difficult. When the bottle 10, containing the device 15, is tilted to liquid pouring or decanting position, as shown in FIG. 6, the force of the outwardly flowing liquid will push the valve 30 away from the valve seat 24, to the extent permitted by, and limited by, the protuberances 35 formed adjacent the distal ends of the elongated stems 34. The valve 30 thus is operatively connected to the valve seat 24, and held captive thereto, by the plural stems 34 and protuberances 35. As will be noted, the valve control arrangement provided by the stems 34 and protuberances 35 renders the valve 30 axially moveable, relative to the valve seat 24, a selected distance sufficient to disengage the valve nipple 33 from the valve seat opening 25.

Disposed between the liquid discharge port 18 and the captive valve 30 is a fixed baffle 38 having a pair of spaced liquid discharge apertures or openings 39, 40 formed therein. The purpose of baffle 38 is to protect the valve 30 from tampering by means of a wire or similar object inserted through the port 18 into the hollow device 15. In order to ensure this safety function of the baffle 38, its apertures 39, 40 are oriented 90° relative to the valve openings 31, 32. When the valve 30 is opened, as illustrated in FIG. 6, the liquid contents of the bottle 10 flows through the valve seat opening 25, the valve openings 31, 32, the baffle apertures 39, 40 and the discharge port 18.

Formed internally of the neck 11 of the bottle 10 is an annular shoulder 44, which is adapted to engage in locking relation with the annulus of hook-like or latch-like elements 21 disposed at the distal ends of the locking fingers 20. By reason of the flexible nature of the fingers 20, and their relative elongation, the distal ends 21 of the fingers are contracted or forced radially inward, when the tubular device 15 is inserted into the neck 11 of the bottle. When the device 15 has been inserted to the proper depth within the neck 11, the distal ends 21 of the fingers 20 spring outward radially, whereby their hook-like elements engage lockingly with the internal annular shoulder 44, as shown in FIG. 1, thereby firmly securing the device 15 internally of the neck 11 of the bottle 10. Although in the embodiment shown, the shoulder 44 is illustrated as comprising the upper portion of an annular recess 45 formed in he neck of the bottle, it will be understood that any equivalent form of annular shoulder, formed in the neck 11 for engagement with the annulus of hooks 21, will be equally effective. For example, the shoulder 44 may be in the form of an annular ridge or bead, or similar annular latch engaging means, to lock the tubular device 15 within the neck 11.

Figure 4:
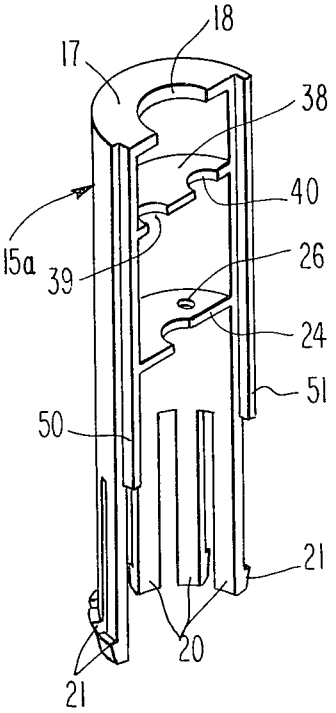
FIG. 4 is a perspective view of one of the two semi-cylindrical components forming the device.
Figure 2:
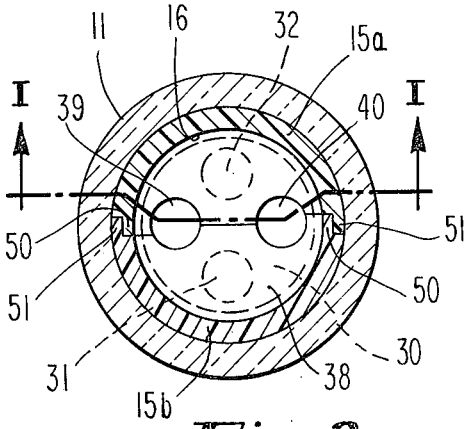
FIG. 2 is an enlarged view in section indicated by the arrows II—II of FIG. 1.

As illustrated in FIGS. 2–5, the device 15 consists of three separate parts, comprising valve 30 and two complementary semi-cylindrical tubular elements 15*a,* 15*b.* The two semi-cylindrical tubular elements are of indentical construction, and when assembled in opposing or mating relation, they form the hollow generally cylindrical body portion 16 of the device 15. As best shown in FIG. 4, each of the semi-cylindrical tubular elements is provided with a pair of diametrically spaced, axially extending lips or tongues 50, 51. As illustrated in FIGS. 2 and 3, when a pair of semi-cylindrical tubular elements 15*a,* 15*b* are assembled in mating relation, their respective lips 50, 51 interengage, to provide the tubular body portion 16.

Preferably, each of the semi-cylindrical tubular components of the body portion 16 has formed integrally therewith half portions of the fixed valve seat 24, the baffle 38 and the end closure 17, as illustrated in FIG. 4. Thus, when the mating halves of the tubular body portion 16 are assembled, the complemental halves of the valve seat 24, baffle 38 and end 17 are joined in contiguous relation.

In practice, it is preferred that the three separate components of the device 15, comprising the semi-tubular elements 15*a,* 15*b* and the valve 30, be made of relatively flexible plastic. They may be produced by the well known plastic injection molding process. The plastic composition of the device 15 may be of a suitable polyamide, or any equivalent plastic material.

Although a preferred embodiment of this invention has been shown and described herein for the purpose of illustration, and as required by Title 35 U.S.C.

Section 112, it is to be understood that various changes and modifications may be made therein without departing from the spirit and utility of the invention, or the scope thereof as set forth in the appended claims.

I claim:

1. A device to prevent refilling of bottle-like liquid containers comprising a. a hollow generally cylindrical body portion having axially spaced upper and lower ends;

b. a liquid discharge port adjacent the upper end of the body portion;

c. locking means adjacent the lower end of the body portion for retaining the device securely within a container;

d. a transverse valve seat disposed internally of the body portion intermediate the discharge port and the locking means, said valve seat having a liquid discharge opening therein;

e. a valve adapted to rest upon the valve seat when the container is not in use;

f. a nipple extending from the valve and adapted to engage within and close the opening in the valve seat; and g. valve control means connecting the valve to the valve seat, said control means being operative to permit the valve to separate a selected distance from the valve seat, to disengage the valve nipple from the valve seat opening, during discharge of liquid from the container;

h. said valve control means comprising at least one elongated stem joined to the valve and extending slidably through the valve seat and having a protuberance formed adjacent its distal end.

2. The device of claim 1, wherein a. an apertured baffle is disposed between the discharge port and the valve;

b. at least one liquid discharge opening is formed in the valve;

c. a plurality of spaced apertures are disposed in the valve seat;

d. the valve control means comprises a plurality of spaced elongated stems, each stem being joined to the valve and extending slidably through an aperture in the valve seat and having a generally conically shaped protuberance formed at its distal end; and e. the locking means comprises a plurality of elongated flexible fingers depending from the body portion, each finger having a generally hook-like element formed adjacent its distal end.

3. The device of claim 2 for use in a container having an annular shoulder formed internally thereof, wherein the generally hook-like elements of the locking means are disposed annularly for engagement with the internal annular shoulder of the container.

4. The device of claim 1, wherein a. the valve seat is a flat disc provided with a plurality of spaced apertures;

b. the valve control means comprises a plurality of spaced elongated stems, each stem being joined to the valve and extending slidably through one of the apertures; and c. each stem has a generally conically shaped protuberance disposed at its distal end;

d. said valve being disposed on one side of the valve seat and the protuberances being disposed on the opposite side of the valve seat, whereby the valve is held captive with capacity for limited axial displacement relative to the valve seat.

5. The device of claim 1, wherein at least one liquid discharge opening is formed in the valve.

6. The device of claim 1, further including an apertured baffle disposed between the discharge port and the valve.

7. The device of claim 1, wherein the discharge port is formed in a transverse closure element adjacent the upper end of the body portion.

8. The device of claim 1, wherein the locking means comprises a plurality of flexible fingers depending from the body portion, each finger having a generally hook-like element formed adjacent its distal end.

9. The device of claim 1, wherein a. the locking means comprises a plurality of elongated flexible fingers depending from the body portion, said fingers being arranged in an annulus of uniformly spaced fingers; and b. a latch-like element is disposed at the distal end of each finger.

10. The device of claim 9 for use in a bottle having a neck and an annular shoulder formed internally of the neck, wherein a. the latch-like elements extend outward radially relative to the body portion;

b. the device is adapted to be inserted into the neck of the bottle; and c. the latch-like elements are disposed annularly for locking engagement with the annular shoulder in the neck of the bottle.

11. The device of claim 1, wherein the body portion comprises a pair of semi-cylindrical tubular elements, said elements having diametrically spaced, axially extending engagement means for assembling a pair of elements in complemental relation to provide a tubular body portion.

12. The device of claim 11, wherein a. each semi-cylindrical tubular element has a pair of diametrically spaced, axially extending lips for engagement with a pair of corresponding lips of a mating tubular element; and b. each tubular element includes an integrally formed portion of the valve seat.

13. The device of claim 12, wherein the mating tubular elements are of identical construction.

14. The device of claim 13, wherein the device is made of plastic.

* * * * *

UNITED STATES PATENT OFFICE

CERTIFICATE OF CORRECTION

PATENT NO. : 4,043,473

DATED : August 23, 1977

INVENTOR(S) : Norma M. Webb

It is certified that error appears in the above-identified patent and that said Letters Patent are hereby corrected as shown below:

Column 1, line 17 change "gove" to --gone--

Column 3, line 35 change "he" to --the--

Column 3, line 66 change "inden-" to --iden- --

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*